US005409312A

United States Patent [19]

Fletcher

[11] Patent Number: 5,409,312

[45] Date of Patent: Apr. 25, 1995

[54] ORBITAL SHAKING ATTACHMENT

[76] Inventor: David J. Fletcher, 18 Lovell Road, Cambridge, CB4 2QR, United Kingdom

[21] Appl. No.: 227,242

[22] Filed: Apr. 13, 1994

[30] Foreign Application Priority Data

Apr. 13, 1993 [GB] United Kingdom ..... 9307573

[51] Int. Cl.[6] ..... B01F 11/00

[52] U.S. Cl. ..... 366/208; 366/237; 366/274

[58] Field of Search ..... 366/208, 209, 210, 211, 366/219, 273, 274, 127, 216, 218, 237, 276, 287, 289; 68/171; 134/118; 422/99

[56] References Cited

U.S. PATENT DOCUMENTS 3,184,222 5/1965 Aronowitz ..... 366/209
4,750,845 7/1988 Nabetani .
5,060,151 10/1991 Mikyska ..... 366/208

FOREIGN PATENT DOCUMENTS 1257588 12/1971 United Kingdom .
1327632 8/1973 United Kingdom .
2057903 4/1991 United Kingdom .
2254423 7/1992 United Kingdom ..... B01F 11/00

*Primary Examiner*—Robert W. Jenkins
*Attorney, Agent, or Firm*—Anthony F. Cuoco

[57] ABSTRACT

An orbital shaking attachment can be fitted or removed from a magnetic stirrer thereby giving the stirrer the extra function of orbital shaking in addition to its primary function of magnetic stirring. The principal of he invention could also be used to make a dedicated orbital shaker for other applications such as in an over, incubator or liquid filled tank. The orbital shaking attachment includes a top-plate/platform with a circular magnet attached centrally to its underside and a base-plate with a central circular hole. The two plates are separated by ball bearings which are able to roll around orbitally in bearing cups on both plates. When operated the base-plate is static and the top-plate/platform moves orbitally. The device is constructed mainly from nonferrous material except for the circular magnet and ball bearings.

4 Claims, 1 Drawing Sheet

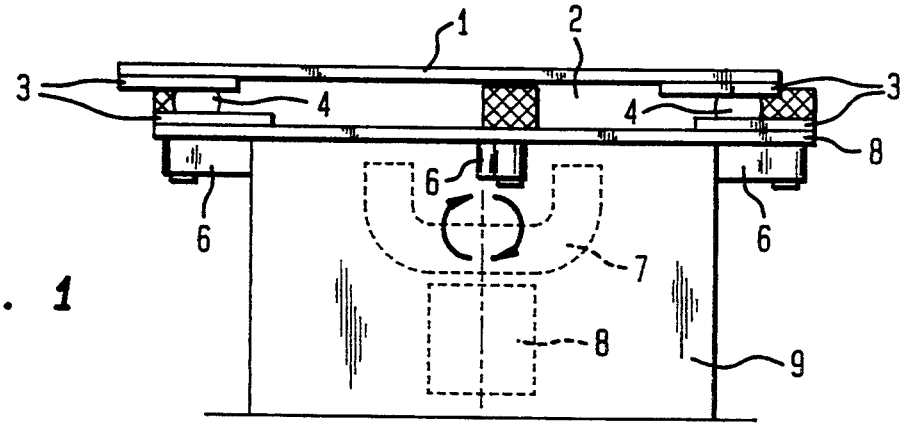
FIG. 1
FIG. 2
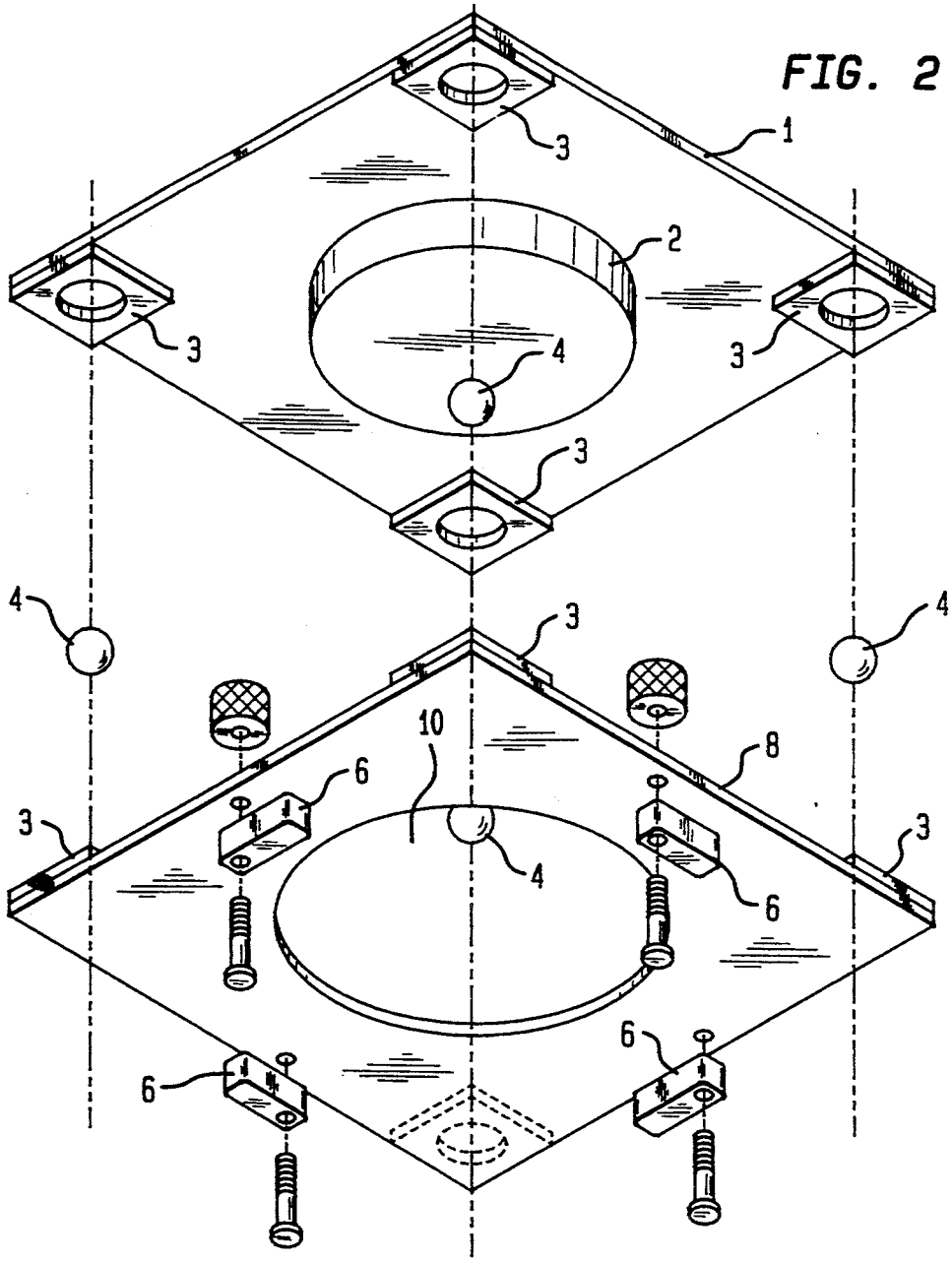

ORBITAL SHAKING ATTACHMENT

BACKGROUND OF THE INVENTION

This invention relates to a magnetically coupled and driven orbital shaking attachment.

Orbital shakers are well known devices comprising a flat table or platform which is moved in a circular gyratory motion, usually by an electric motor. Flasks containing liquid are placed on the table and its orbital motion acts on the liquid in the flask to give a swirling, shaking movement to stir and mix the liquid.

These machines are relatively expensive and are generally exclusive for the one function.

SUMMARY OF THE INVENTION

The present invention consists of a magnetically coupled and driven table which is used as an attachment to another device, namely a magnetic stirrer. Magnetic stirrers comprise an electric motor with a magnet fixed horizontally to one end of the motor shaft. The rotating magnet is placed in close proximity to the base of a flask of liquid in which there is a magnetic bar. The magnetic bar will follow the motion of the driven magnet and provide a stirring action to the liquid. The driven magnet on a magnetic stirrer is a form of power which can be magnetically coupled to the present invention thereby giving the dual function of magnetic stirring or orbital shaking to a magnetic stirrer. Moreover, if the magnetic stirrer incorporates a heater, then this function can also be used on the orbital shaking device. The present invention could also be placed on the bottom of a tank of liquid with the magnetic coupling being made by a rotating magnet mounted in close proximity to the outside of the base of the tank. The principal of this invention could also be applied to make a dedicated orbital shaking machine that could be used within an oven, incubator, flameproof area or any other vessel or tank where, for example, the use of electrical equipment would be a hazard and by using the same type of rotating magnetic coupling on the outside of such a container as the means of propulsion.

According to the present invention, there is provided an orbital shaking attachment comprising a base-plate with means to secure it to a magnetic stirrer, and a top-plate/platform with a circular magnet attached centrally to its underside. Eight bearing cups, one fitted to each corner of the two plates and in exact relative alignment and four ball bearings sized to roll around the cups freely and provide the circular orbital motion to the top-plate/platform. The number and arrangement of ball bearings and cups may be varied from this basic design to accommodate different dimensions or load capacities. A means of attachment to a magnetic stirrer that will keep the base-plate stationary and allow the top-plate/platform to travel in a discrete orbital motion when the magnetic stirrer is operated. The device must be constructed mainly from nonferrous material such as aluminum with the exception of the circular magnet attached to the top-plate/platform and possibly the ball bearings.

BRIEF DESCRIPTION OF THE DRAWINGS

FIG. 1 shows a side view of the orbital shaking attachment fixed on a simple schematic representation of a magnetic stirrer showing the internal arrangement of the moving magnet on the magnetic stirrer.

FIG. 2 shows an exploded diagram of the orbital shaking attachment in perspective, showing the constituent parts of the device looking from below.

DETAILED DESCRIPTION OF THE INVENTION

Referring to the drawing, the orbital shaking attachment comprises a base-plate 5 with four ball bearing cups 3, and a central hole 10, sized to accommodate the travel of the circular magnet 2 attached to the top-plate/platform 1. FIGS. 1 and 2 show a means of securing the base-plate 5 to different sizes of magnetic stirrers using adjustable eccentric cams 6, but other means may be used such as straps, brackets, screws, designed to fit a particular magnetic stirrer or similar means (not shown). A top-plate/platform 1 with four bearing cups 3 positioned in exact alignment with the bearing cups on the base-plate, a circular magnet 2 attached to the central underside of the top-plate/platform and four suitably sized ball bearings 4 to fit between top-plate/platform 1 and base-plate 5 and running loosely in the bearing cups 3 to allow an orbital motion.

In order to operate the shaker, the base-plate 5 is suitably positioned and secured on the magnetic stirrer operating platform as in FIG. 1. The four ball bearings 4 are placed into the base-plate bearing cups 3 and the top-plate/platform 1 lowered onto the ball bearings 4, lining up the bearing cups on the top and base-plates. When the magnetic stirrer 9 is operated the magnet 7 turns and couples to the circular magnet 2 on the top-plate/platform 1 and allows it to move in an orbital motion as determined by the ball bearings 4 running in the bearing cups 3. To dismount the orbital shaker from the magnetic stirrer the above steps are carried out in reverse order.

What is claimed is:

1. An orbital shaking attachment comprising:

a top-plate/platform with a circular magnet attached centrally to its underside;

a base-plate;

two plates having bearing cups around their periphery positioned in exact alignment relative to said two plates to accommodate loose fitting ball bearings which separate said two plates and which allow the top-plate to move in a discrete orbital motion when its circular magnet is magnetically coupled to the rotating magnet on a magnetic stirrer.

2. An orbital shaking attachment as claimed in claim 1 wherein:

the base plate is provided with a hole suitably sized to accommodate the travel of the circular magnet on the underside of the top-plate/platform thus allowing the circular magnet to be as close as possible to the driven magnet on the magnetic stirrer or the like.

3. An orbital shaking attachment as claimed in claim 2, wherein means are provided to secure the device to a magnetic stirrer thus allowing the base plate to remain static when the device is operated.

4. An orbital shaking attachment as claimed in claim 1 wherein:

means are provided to secure the device to a magnetic stirrer thus allowing the base-plate to remain static when the device is operated.

* * * * *